US008790129B1

(12) United States Patent
Rengifo et al.

(10) Patent No.: US 8,790,129 B1
(45) Date of Patent: Jul. 29, 2014

(54) USER CONFIGURABLE CONNECTOR

(71) Applicant: Deutsch Engineered Connecting Devices, Inc., Hemet, CA (US)

(72) Inventors: Alex Robert Rengifo, Oceanside, CA (US); Troy Tom, Oceanside, CA (US)

(73) Assignee: Deutsch Engineered Connecting Devices, Inc., Hemet, CA (US)

( * ) Notice: Subject to any disclaimer, the term of this patent is extended or adjusted under 35 U.S.C. 154(b) by 34 days.

(21) Appl. No.: 13/740,676

(22) Filed: Jan. 14, 2013

(51) Int. Cl.
*H01R 13/58* (2006.01)

(52) U.S. Cl.
USPC ..... 439/468

(58) Field of Classification Search
USPC ..... 439/468, 752, 902, 470, 473, 686, 701
See application file for complete search history.

(56) References Cited

U.S. PATENT DOCUMENTS

| | | | | |
|---|---|---|---|---|
| 3,824,523 | A | 7/1974 | McGhee | |
| 3,905,672 | A | 9/1975 | Anhalt et al. | |
| 4,946,402 | A | 8/1990 | Fink et al. | |
| 5,711,685 | A | 1/1998 | Wood | |
| 6,419,522 | B1 * | 7/2002 | Bonilla | 439/595 |
| 7,128,601 | B2 * | 10/2006 | Suemitsu et al. | 439/521 |
| 8,192,229 | B2 * | 6/2012 | Endo | 439/596 |
| 8,568,159 | B2 * | 10/2013 | Noda et al. | 439/470 |
| 2012/0231672 | A1 | 9/2012 | Jehmlich et al. | |

FOREIGN PATENT DOCUMENTS

| | | | |
|---|---|---|---|
| EP | 0 805 522 | A2 | 11/1997 |
| JP | 2001 143812 | A | 5/2001 |

OTHER PUBLICATIONS

Annex to Form PCT/ISA/206, Communication Relating to the Results of the Partial International Search, International Application No. PCT/US2014/010990, International Filing Date, Jan. 10, 2014.

* cited by examiner

*Primary Examiner* — Phuong Dinh
(74) *Attorney, Agent, or Firm* — O'Melveny & Myers LLP

(57) ABSTRACT

A system and method is provided for assembling and/or customizing a connector. Preferred embodiments of the present invention operate in accordance with a connector that includes a plurality of removable contacts, and a connector body that can be customized to mate with a corresponding, and similarly configured connector. In one embodiment of the present invention, a contact is connected to a wire and inserted into an aperture in a retainer. The retainer is then inserted into a connector body, thereby resulting in an increase in friction between the retainer and the contact, and a backshell is attached to the connector body. At least one key is placed in at least one keyway on the connector body, resulting in a user-programmable connector. The connector is then mated with a corresponding connector that is similarly configured. The connectors are then secured using either a latch or lanyard mechanism.

28 Claims, 5 Drawing Sheets

USER CONFIGURABLE CONNECTOR

BACKGROUND OF THE INVENTION

1. Field of the Invention

The present invention relates to a user configurable connector, or more particularly, to a connector that can be (i) assembled and/or customized by a user and/or (ii) connected to and/or disconnected from a corresponding connector without the need for special equipment.

2. Description of Related Art

Connectors are used in many applications, including commercial, consumer and military applications. Connectors are typically used to transmit information (e.g., a voltage, current, etc.) from a first device to a second device. For example, a connector may be used to provide power from a power supply to a circuit. By way of another example, a connector may be used to provide analog and/or digital information from a first circuit to a second circuit.

Connectors are generally customized for a particular application. By way of example, assume that a device needs to be connected to two different wire harnesses; a first wire harness that transmits power, and a second wire harness that communicates digital signals. In order to prevent the first wire harness (transmitting power) from being plugged into the logic I/O of the device, and the second wire harness (communicating digital signals) from being plugged into the power supply of the device, different connectors must be used. In other words, the plug used to transmit power to the device must be different from the plug used to communicate digital signals to/from the device. Further, each pin in each plug must be connected to a particular wire. For example, assume that a first receptacle is connected to the power supply of the device. If a first socket in the first receptacle requires a first voltage (e.g., $V_{DD}$) and a second socket in the first receptacle requires a second voltage (e.g., ground), then a wire carrying the first voltage must be connected to a first pin in a first plug, and a wire carrying the second voltage must be connected to a second pin in the first plug.

A drawback of the foregoing, is that certain equipment is generally required to replace (or swap out) such a connector. For example, if a connector needs to be replaced (e.g., a pin gets corroded or breaks, a wire breaks, etc.), a custom connector (i.e., a duplicate of the one being replaced) must be acquired, and each contact in the new connector must be connected (e.g., crimped, soldered, etc.) to a corresponding wire. Thus, not only does a user need to source a new connector, but he may need certain tools to (i) disconnect the faulty connector (e.g., faulty plug) from a corresponding connector (e.g., receptacle), (ii) disconnect the wire harness from the faulty connector, (iii) connect each contact in the new connector to a corresponding wire, (iv) attach a backshell to the new connector, and (v) connect the new connector (e.g., new plug) to the corresponding connector (e.g., receptacle). Not only is this a waste of time, but it is also a waste of money. This is especially true if the only reason the connector is being replaced is because of a single faulty contact.

Thus, it would be advantageous to manufacture a user configurable connector that can be connected to and disconnected from a corresponding connector without the need for special tools. It would also be advantageous to manufacture a connector that a user can customize (or key) so that it only mates with a corresponding connector. This would allow a user to purchase a common connector and customize (or key) it so that it only works in a particular application (i.e., an application that includes a corresponding, or complimentary-keyed connector). It would further be advantageous to manufacture a connector that includes removable contacts, thereby allowing a user to remove and/or replace a single contact if that contact is deemed to be faulty or damaged.

SUMMARY OF THE INVENTION

The present invention provides a user-configurable connector, or a connector that can be (i) assembled and/or customized by a user and/or connected to and/or (ii) disconnected from a corresponding connector without the need for special equipment. Preferred embodiments of the present invention operate in accordance with a connector that includes a plurality of removable contacts, and a connector body that can be customized (or keyed) to mate with a corresponding, and similarly configured connector.

In one embodiment of the present invention, the connector includes a connector body, a retainer, a plurality of contacts, and a backshell, wherein each one of the contacts is configured to be connected to a corresponding wire, and inserted into a corresponding aperture in the retainer. After each contact is connected to a wire and inserted into the retainer, the retainer is then inserted into a proximal end of the connector body. In one embodiment of the present invention, the proximal end of the connector body includes a cavity configured to receive at least a portion of the retainer. A backshell is then connected to the connector body.

In one embodiment of the present invention, the cavity in the connector body is slightly smaller than the outer surface of the retainer. By configuring the cavity and the retainer in this fashion, pressure (or increased friction) can be applied to the plurality of contacts when the retainer is place (or pressed) in the cavity of the connector body. In another embodiment of the present invention, the backshell is configured so that when it is connected to the connector body, pressure (or increased friction) is applied to the plurality of contacts. In other words, regardless of the embodiment used, the user-configurable connector is designed so that when the retainer is removed from the connector body, each contact is relatively easy to insert into and remove from the retainer. However, when the retainer is inserted into the connector body, and/or the backshell is attached to the connector body, each contact is securely retained. In fact, it becomes difficult (if not impossible) to insert a contact into, or remove a contact from the retainer when the retainer is inserted into the connector body and/or when the backshell is attached to the connector body. This difficulty, or impossibility is based on an application of pressure on the retainer (from the cavity and/or the backshell), which results in increased friction between the retainer and the plurality of contacts.

In one embodiment of the present invention, the retainer further includes a plurality of "fingers" extending inward toward each contact. By including a plurality of "fingers" in each aperture in the retainer, it may be easier to convert the pressure applied to the retainer (by the cavity and//or the backshell) into increased friction on the plurality of contacts.

In yet another embodiment of the present invention, the backshell includes first and second portions, wherein the first portion includes a set of latches and a first post, and the second portion includes a first set of slots and a second post. In this embodiment, the backshell is connected to the connector body by placing the first post into a first hole in the connector body, and by placing the second post into a second hole in the connector body. The first and second portions of the backshell are then connected together by snap-fitting the set of latches into the set of slots. In one embodiment of the present invention, this may result in the application (or further application) of pressure on the retainer, thereby securing the plurality of contacts in place.

Once the user-configured connector is assembled, it can then be connected to a corresponding connector. In one embodiment of the present invention, a latching mechanism (e.g., a T-shaped latch) is used to secure a first connector to a second connector. Specifically, a first end of the latch includes a pivot for pivotally connecting the latch to the first connector, and a second end of the latch includes at least one dentent. Once the first connector is mated with the second connector, the latch can be pivoted until the dentent is secured in a pair of deflectable fingers. In particular, the pair of deflectable fingers includes an indented inner portion adapted to receive the dentent(s). By applying pressure on the latch toward the second connector, the deflectable fingers will temporarily spread apart, allowing the detent to move into the indented inner portion. With the dentent in place, the deflectable fingers will spring back to their initial position, thereby preventing the latch from moving away from the second connector, such as in the case of high vibration.

In another embodiment of the present invention, a lanyard mechanism is used to secure a first connector to a second connector. Specifically, the first connector includes a first dovetail, the second connector includes a second dovetail, and the lanyard mechanism includes a slot and a latch, wherein the slot is configured to mate with the first dovetail, and the latch is configured to hook over the second dovetail. In other words, the lanyard mechanism can be affixed to the first connector by mating the first slot with the first dovetail. By pressing the first and second connectors together, the latch of the second connector hooks (or snap-fits) over the second dovetail on the second connector. In order to disconnect the first connector from the second connector, the latch must first be removed (or separated) from the second dovetail. This can be done, for example, by pulling on a handle portion (i.e., the lanyard) of the lanyard mechanism, thereby moving the latch away from the second connector, and away from the second dovetail.

In one embodiment of the present invention, the first and second dovetails are similarly shaped and sized, allowing the lanyard mechanism to be affixed to either the first or second connector. In other words, the slot in the lanyard is configured to mate with both the first and second dovetails. By doing this, the lanyard becomes reversible, and can be affixed to ether the first connector or the second connector, as desired by the user, or required by the application.

In another embodiment of the present invention, the connector can be customized by the user so that it only mates with a similarly configured connector. In this embodiment, the connector body includes a plurality of keyways, wherein each keyway is configured to receive a key. If the user wants to configure a connector so that it only mates with a similarly configured connector, the user can do this by inserting at least one key in at least one keyway on the connector, and remove the key (or ensure that there is no key) in the corresponding keyway on the corresponding connector. By allowing a user to customize (or key) a connector, the user can configure the connector so that it only mates with a corresponding, and similarly configured connector. This is advantageous in that the user does not have to purchase a custom connector, in order to have a custom (or semi-unique) connector.

The present invention further provides a method for assembling and customizing a connector in accordance with one embodiment of the present invention. First, a plurality of contacts (e.g., pins, sockets, etc.) are connected to corresponding wires. Each contact is then inserted into an aperture in a retainer. The retainer is then inserted into a connector body, and a backshell is attached to the connector body. In one embodiment, the insertion of the retainer into the connector body results in increased friction between the elastomeric retainer and the contacts included therein. In another embodiment, the attachment of the backshell to the connector body results in an application of pressure on the elastomeric retainer, which further results in increased friction between the elastomeric retainer and the contacts included therein. At least one key is placed in at least one keyway on a distal end of the connector body, resulting in a user-programmable connector. The connector is then mated with a corresponding connector that is similarly configured. The connector is then secured to the corresponding connector by either snap-fitting a latch into a corresponding indented inner portion, or snap-fitting a lanyard latch over a corresponding dovetail.

A more complete understanding of a system and method for manufacturing and assembling a connector will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF THE PREFERRED EMBODIMENT

The present invention provides a connector that can be (i) assembled and/or customized by a user and/or (ii) connected to and/or disconnected from a corresponding connector without the need for special equipment. In the detailed description that follows, like element numerals are used to describe like elements illustrated in one or more figures.

Figure 1:
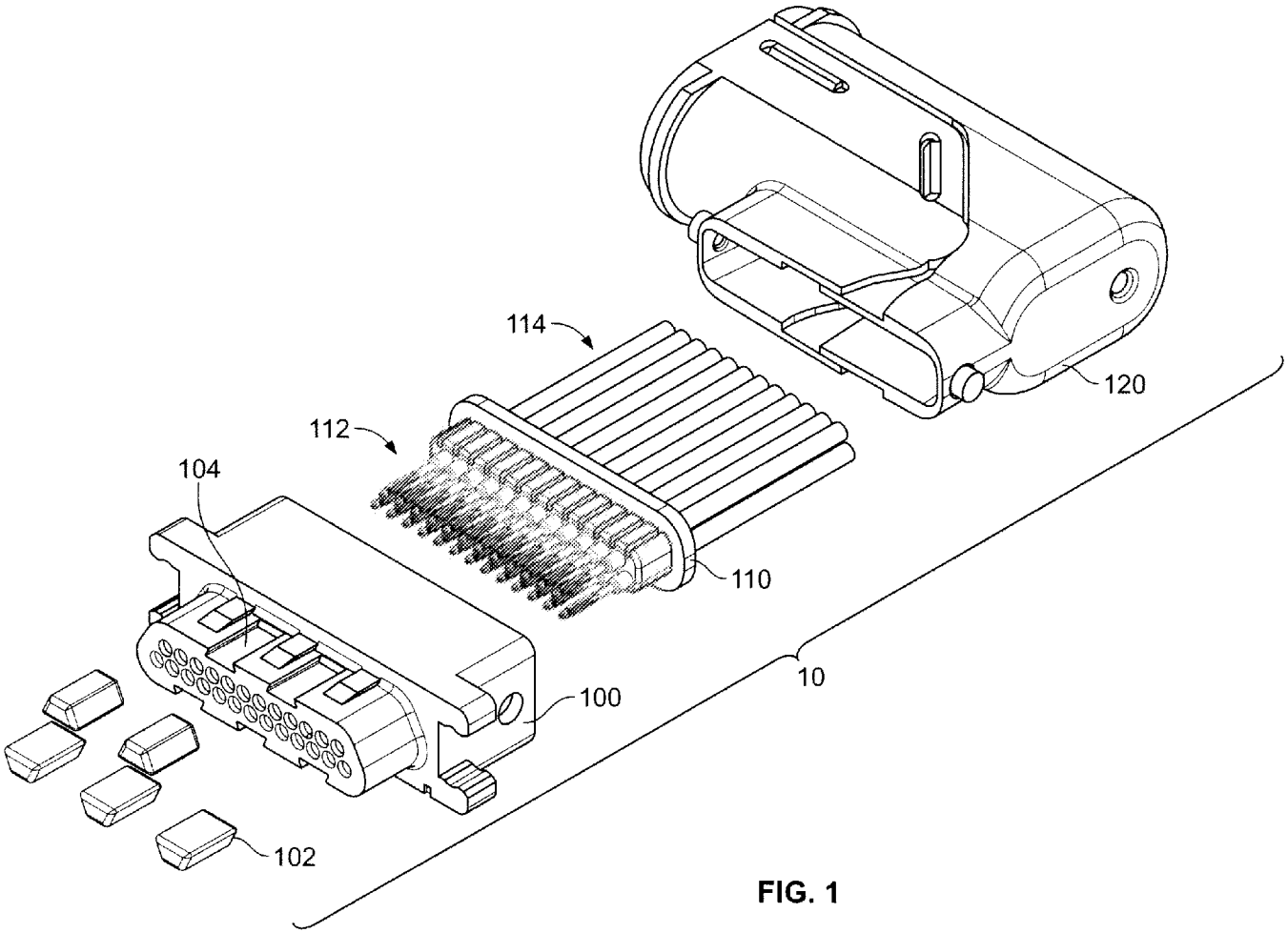
FIG. 1 shows an exploded view of a connector in accordance with one embodiment of the present invention, comprising a connector body, a backshell, a retainer, a plurality of contacts, and a plurality of user-removable keys.

A user-configurable connector in accordance with one embodiment of the present invention is shown in FIG. 1. Specifically, the connector 10 includes a connector body 100, a retainer 110, a plurality of contacts 112, and a two-piece backshell 120. Each one of the plurality of contacts is configured to be connected to a corresponding wire. This can be done, for example, by crimping a proximal end of each contact around a corresponding wire, soldering a proximal end of each contact to a corresponding wire, etc. Once the plurality of contacts 112 are connected to a plurality of wires 114, each contact is inserted into a corresponding aperture in the retainer 110. The retainer 110 is then inserted into a proximal end of the connector body 100. In one embodiment of the present invention, the proximal end of the connector body 100 includes a cavity configured to receive at least a portion of the retainer, and the distal end of the connector body includes a plurality of apertures configured to receive at least a portion of the plurality of contacts. The backshell 120 is then connected to the connector body 100.

In a preferred embodiment of the present invention, the connector 10 is configured so that the step of placing (or pressing) the retainer 110 into the connector body 100 results in an application of pressure on the retainer 110, thereby resulting in increased friction between the retainer and the plurality of contacts. In an alternate embodiment of the present invention, the connector 10 is configured so that the step of connecting the backshell 120 to the connector body 100 results in an application of pressure on the retainer 110, thereby resulting in increased friction between the retainer and the plurality of contacts. In either embodiment, the user-configurable connector is designed so that when the retainer is removed from the connector body, each contact is relatively easy to insert into and remove from the retainer (e.g., a relatively low amount of friction exists between each contact and a corresponding aperture in the retainer). However, when the retainer is inserted into the connector body and/or the backshell is attached to the connector body, each connector becomes securely retained in the retainer.

In the first embodiment of the present invention, it becomes difficult (if not impossible) to insert a contact into, or remove a contact from the retainer when the retainer is inserted into the connector body. In the second embodiment of the present invention, it become difficult (if not impossible) to insert a contact into, or remove a contact from the retainer when the backshell is attached to the connector body. In either embodiment, or in a third embodiment, which is a combination of the two, assembling the connector results in a relatively high amount of friction between each contact and a corresponding aperture in the retainer.

By designing the user-configurable connector in this fashion, individual contacts can be removed and replaced without having to replace the actual connector. This can be accomplished, for example, by removing the backshell from the connector body, removing the retainer from the connector body, removing the faulty contact from the retainer, inserting a new contact into the retainer, inserting the retainer into the connector body, and connecting the backshell to the connector body. As stated above, by "sandwiching" the retainer into the connector body and/or between the backshell and the connector body, the increased pressure on the retainer results in closure (or attempted closure) of the apertures in the retainer. It is this closure (or attempted closure) that limits (or prevents) movement of the contacts within the retainer.

It should be appreciated that the present invention is not limited to the connector illustrated in FIG. 1. For example, the present invention may be implemented in either a plug having a plurality of pins, or a receptacle having a plurality of sockets. It should also be appreciated that the present invention is not limited to any particular type of retainer. For example, a retainer manufactured out of any known pliable material (e.g., an elastomeric material, a thermo-plastic elastomeric material, etc.) is within the spirit and scope of the present invention. It should further be appreciated that the present invention is not limited to the use of any particular type of backshell. Thus, any backshell (or backing structure) that can be connected to the connector body (e.g., using screws, a snap-fit connector, etc.), and results in the application of pressure on the retainer, is considered to be within the spirit and scope of the present invention.

Figure 2:
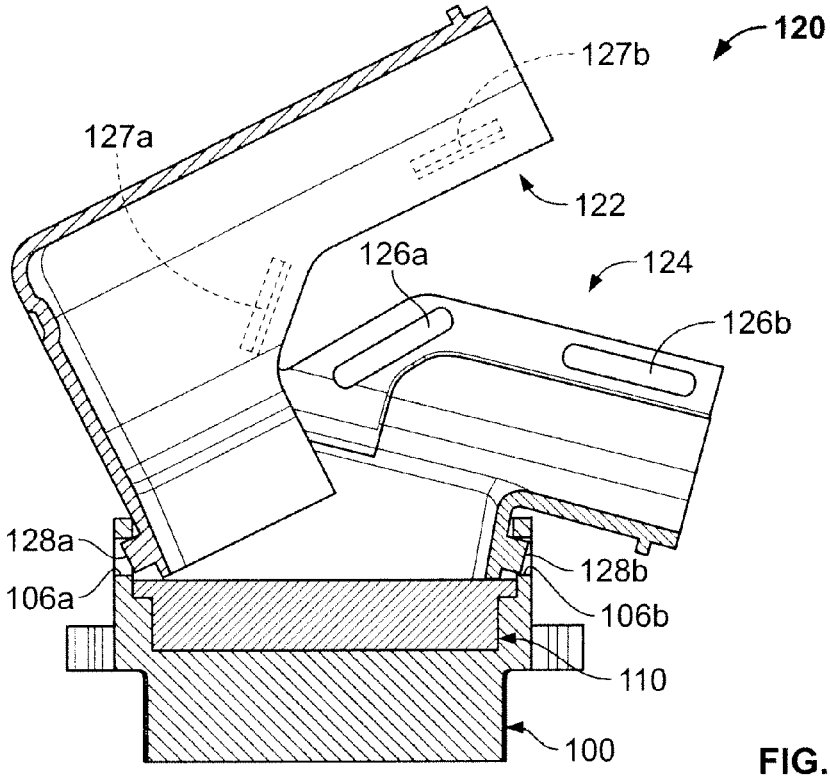
FIG. 2 shows the backshell illustrated in FIG. 1, and how it can be connected to the connector body and used to secure the plurality of contacts in the retainer.

In one embodiment of the present invention, as shown in FIGS. 1 and 2, the backshell 120 includes first and second portions (122, 124), wherein the first portion 122 includes a set of latches (not shown) and a first post 128*a*, and the second portion 124 includes a set of slots (126*a*, 126*b*) and a second post 128*b*. As shown in FIG. 2, the backshell 120 can be connected to the connector body 100 by placing the first post 128*a* into a first hole 106*a* in the connector body 100, and by placing the second post 128*b* into a second hole 106*b* in the connector body 100. The first and second portions of the backshell (122, 124) can then be connected together by snap-fitting the set of latches (not shown) into the set of slots (126*a*, 126*b*). In one embodiment of the present invention, this results in the application (or further application) of pressure on the retainer 110, thereby securing the plurality of contacts in place. Further, by using a multi-portion backshell that includes at least one post, hole, latch and/or slot, the backshell can be attached to the connector body without the need for any tool, or at least any special tool.

Figure 3:
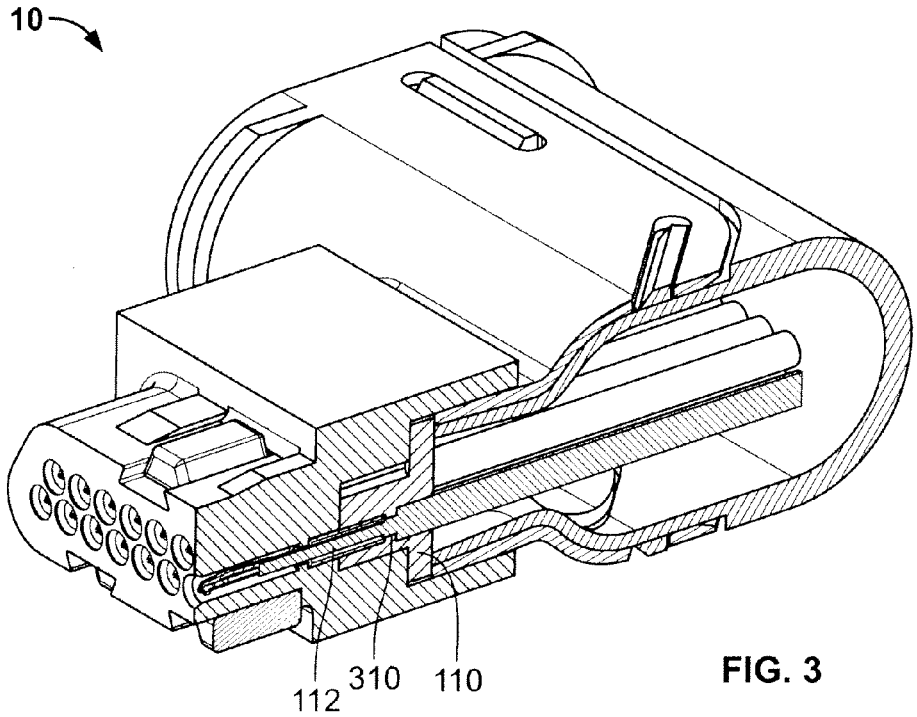
FIG. 3 shows an assembled view of the connector illustrated in FIG. 1.

This can also be seen in FIG. 3, which shows the user-configurable connector 10 fully assembled. FIG. 3 further shows that the retainer 110 (e.g., elastomeric retainer) may also include a plurality of "fingers" 310 extending inward toward each contact. By including a plurality of "fingers" (or a plurality of inwardly protruding, and spaced apart elements) in each aperture in the elastomeric retainer, it may be easier to convert the pressure applied by the connector body (or the backshell) into increased friction on the plurality of contacts. As discussed above, the features shown in FIGS. 2 and 3 are merely exemplary, and are not limitations of the present invention. For example, a backshell that includes one or more portions, and any suitable structure for affixing the backshell to the connector body, is within the spirit and scope of the present invention.

Figure 4:
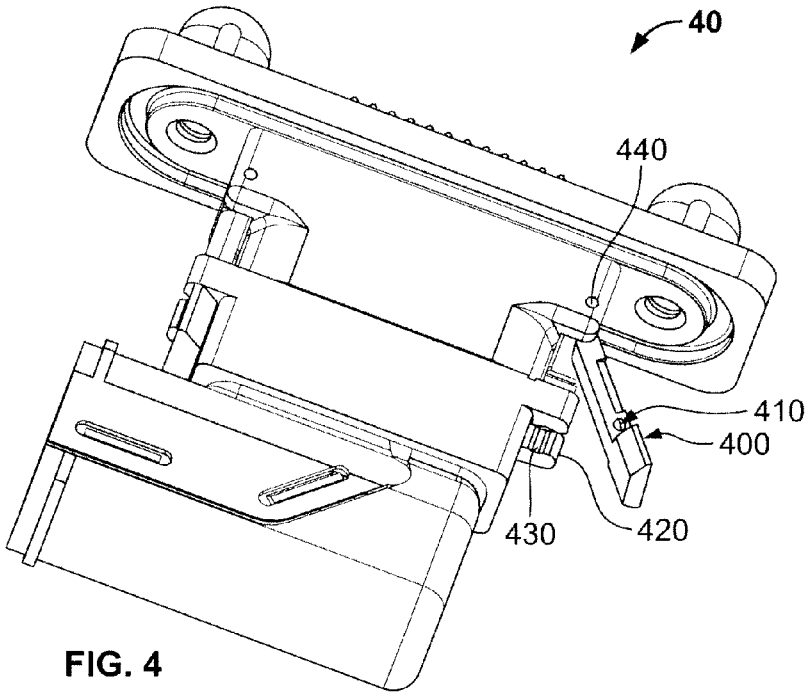
FIG. 4 illustrates a latching mechanism in accordance with one embodiment of the present invention, comprising a T-shaped latch and a latch receiver.
Figure 5:
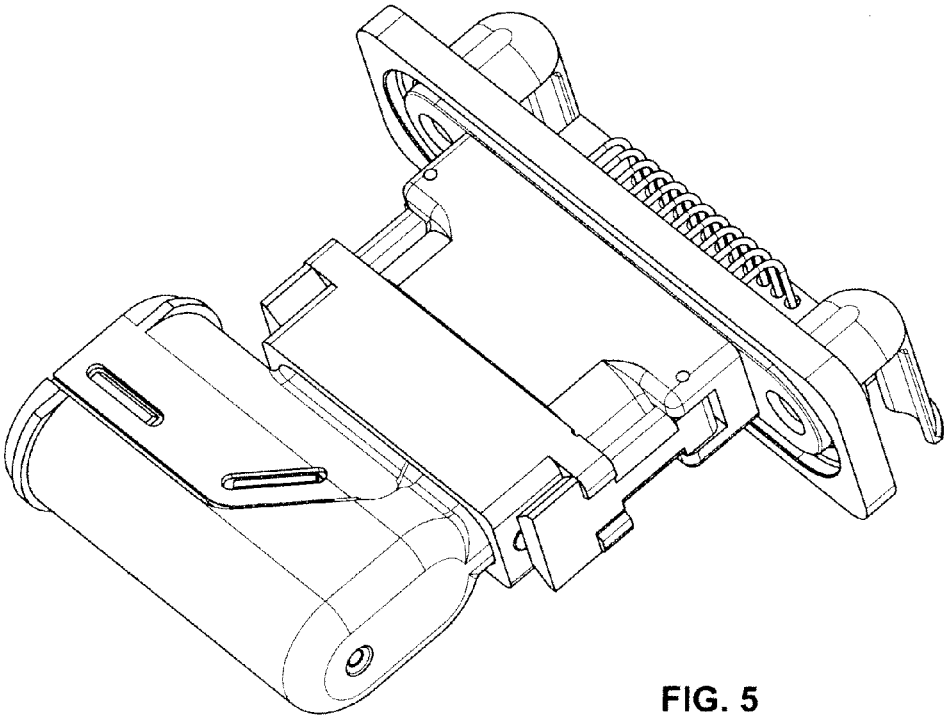
FIG. 5 shows the latch mechanism illustrated in FIG. 4, in a mated configuration.

Once the user-configured connector is assembled, it can then be connected to a corresponding connector (e.g., a corresponding plug, a corresponding receptacle, etc.). While screws are generally used to hold (or secure) connectors together, there are drawbacks to using screws. For example, it takes tools (e.g., a screwdriver, etc.) and a certain amount of time to insert and remove a screw. By way of another example, screws can be dropped during installation/removal, which can result in damage to the connectors (e.g., when they are being connected together). Thus, in one embodiment of the present invention, a latching mechanism (e.g., a T-shaped latch) that does not require screws is used to secure first and second connectors together. This can be seen, for example, in FIG. 4, where a T-Latch 400 is used to secure a first connector 40 to a second connector 10. Specifically, a first end of the T-latch 400 includes a pivot 440 for pivotally connecting the T-latch 400 to the first connector 40, and a second end of the T-latch 400 includes a dentent 410. Once the first connector 40 is mated with the second connector 10, the T-latch 40 can be pivoted until the dentent 410 is secured in a pair of deflectable fingers 420. In particular, the pair of deflectable fingers 420 includes an indented inner portion 430 adapted to receive the dentent 410. By applying pressure on the T-latch 400 toward the second connector 10, the deflectable fingers 420 will temporarily spread apart, allowing the dentent 410 to move into the indented inner portion 430. With the dentent 410 in place, the deflectable fingers 420 will spring back to their initial position, thereby preventing the T-latch from moving away from the second connector 10. This can be seen, for example, in FIG. 5. It should be appreciated that the present invention is not limited to the 1-latch shown in FIGS. 4 and 5. For example, any latch that is pivotally connected to a first connector and can be snap-fitted into a receiving device on a second connector is within the spirit and scope of the present invention. As discussed above, the snap-fitting may include, for example, one or more dentents (e.g., a first dentent on a first side of the latch and second dentent on a second and opposite side of the latch), or the like, and one or more indented inner portions, or the like.

Figure 6:
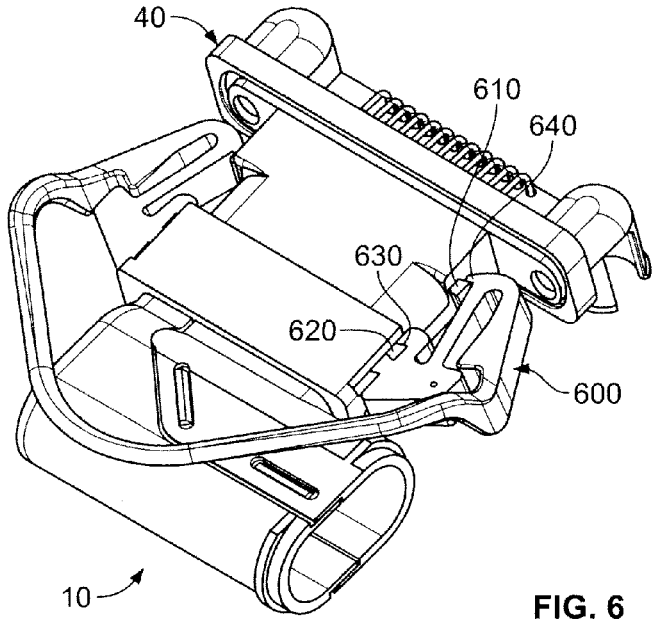
FIG. 6 illustrates at latching mechanism in accordance with another embodiment of the present invention, comprising at least one dovetail and a lanyard mechanism.

In an alternate embodiment, a lanyard mechanism that does not include any screws can be used to secure first and second connectors together. FIG. 6 shows a lanyard mechanism 600 in accordance with one embodiment of the present invention. In particular, a connector 10 includes a first dovetail 620, a second connector 40 includes a second dovetail 610, and the lanyard mechanism 600 includes a slot 630 and a latch 640, wherein the slot 630 is configured to mate with the first dovetail 620, and the latch 640 is configured to hook over the second dovetail 610. In other words, the lanyard mechanism 600, which includes a first (or right) portion, a second (or left) portion substantially parallel to the first portion, and a third (or handle) portion connecting the first and second portions, can be affixed to the first connector 10 by mating the first slot 630 with the first dovetail 620. By pressing the first and second connectors (10, 40) together, the latch 640 of the second connector 40 hooks (or snap-fits) over the second dovetail 610 on the second connector 40. In order to disconnect the first connector 10 from the second connector 40, the hook 640 must first be removed (or separated) from the second dovetail 610. This can be done, for example, by pulling on the handle portion (i.e., the lanyard) of the lanyard mechanism 600, thereby moving the hook 640 away from the second connector 40, and away from the second dovetail 610.

In one embodiment of the present invention, the first and second dovetails are similar in shape and size, allowing the lanyard to be affixed to either the first or second connector. In other words, the slot 630 in the lanyard mechanism 600 is configured to mate with both the first and second dovetails (610, 620). By doing this, the lanyard becomes reversible, and can be affixed to ether the first connector 10 or the second connector 40, as desired by the user, or required by the application. It should be appreciated, however, that the present invention is not limited to any particular type of lanyard mechanism, or to the lanyard mechanism shown in FIG. 6. For example, a connector that includes a differently shaped lanyard mechanism, additional dovetails (e.g., dovetails on both sides of each connector, etc.), and/or additional slots (e.g., slots on both the first and second portions of the lanyard mechanism, etc.), is within the spirit and scope of the present invention.

In another embodiment of the present invention, the connector can be customized by the user so that it only mates with a similarly configured connector. Such a connector can be seen, for example, in FIG. 7. Therein, the connector body 100 includes a plurality of keyways (e.g., 710), wherein each keyway is configured to receive a key (e.g., 720). See also FIG. 1 at 102 and 104. If the user wants to configure a pair of connectors (e.g., a connector and a corresponding connector) so that they will only mate with each other, this can be accomplished by inserting a key in at least one keyway on the connector, and remove the key (or ensure that there is no key) in the corresponding keyway on the corresponding connector.

Figure 7:
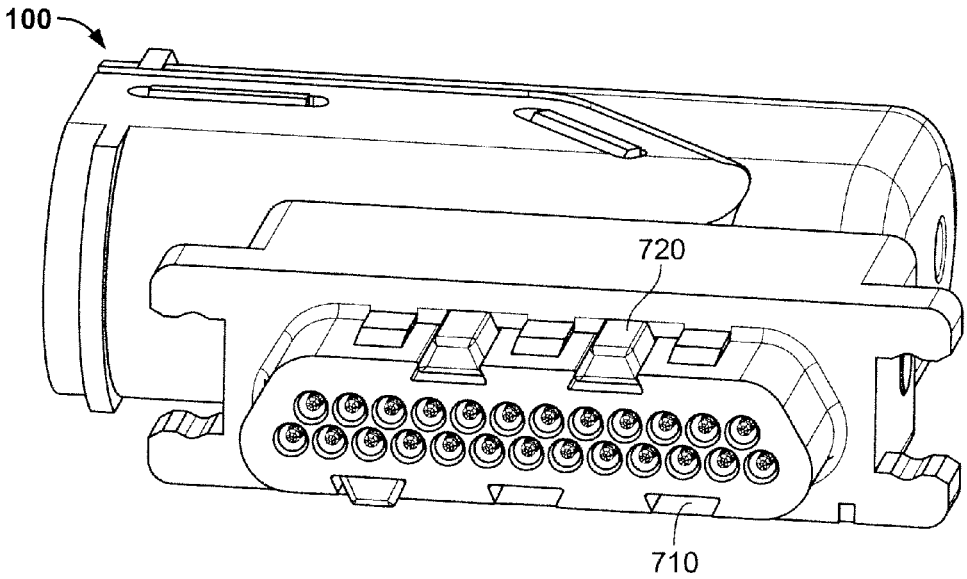
FIG. 7 shows the user-removable keys illustrated in FIG. 1, and how the keys can be inserted into and removed from a plurality of keyways.

By way of example, the connector in FIG. 7 includes five keyways: two on top and three on bottom. As shown in FIG. 7, keys are inserted into the two keyways on top of the connector body 100, and one keyway on the bottom-left of the connector body 100. By doing this, the connector can be configured to mate with a corresponding, and similarly configured connector (e.g., one having no keys in the keyways on the top of the corresponding connector, and in the bottom-right keyway of the corresponding connector (La, the keyway in the corresponding connector that mirrors the bottom-left keyway of the connector)). By allowing a user to customize (or key) a connector, the user can configure the connector so that it only mates with corresponding, and similarly configured connector. This is advantageous in that the user does not have to purchase a custom connector, in order to have a custom (or semi-custom) connector. It should be appreciated that the present invention is not limited to the user-configurable connector illustrated in FIG. 7, and that a connector body that includes fewer or greater keyways and/or keys is within the spirit and scope of the present invention.

Figure 8:
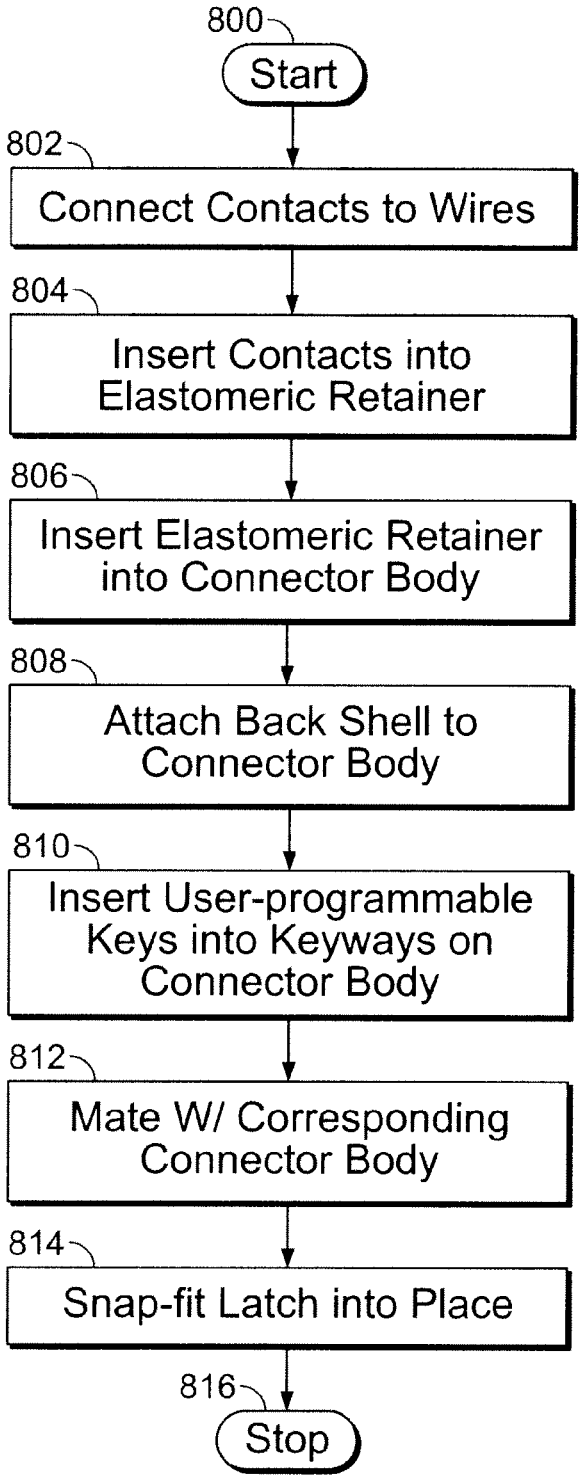
FIG. 8 illustrates a method of assembly a connector and connecting the connector with a corresponding connector in accordance with one embodiment of the present invention.

FIG. 8 illustrates one method of assembling a user-configurable connector and mating the connector with a corresponding connector, in accordance with one embodiment of the present invention. In particular, starting a step 800, at least one contact (e.g., a pin, socket. etc.) is connected to at least one wire at step 802. For example, a proximal end of each contact may include a crimp barrel, a solder socket, etc. At step 804, each contact is inserted into an aperture in an elastomeric retainer. The elastomeric retainer is then inserted into a connector body at step 806, and a backshell is attached to the connector body at step 808. In one embodiment, the insertion of the elastomeric retainer results in an application of pressure on the elastomeric retainer, which further results in increased friction between the elastomeric retainer and the contact(s) included therein. In a second embodiment, the attachment of the backshell to the connector body results in an application of pressure on the elastomeric retainer, which further results in increased friction between the elastomeric retainer and the contact(s) included therein. At step 810, at least one key is placed in at least one keyway on a distal end of the connector body, resulting in a user-programmable connector. The connector is then mated with a corresponding connector that is similarly configured. At step 814, the connector is then secured to the corresponding connector by either snap-fitting a latch (e.g., a T-latch, etc.) into a corresponding indented inner portion, or snap-fitting a lanyard latch over a corresponding dovetail, ending the method at step 816. It should be appreciated that the foregoing steps do not need to be performed in the order presented in FIG. 8. For example, the step of inserting keys can be performed before the contact is connected to wire, before the elastomeric retainer is inserted into the connector body, or before the backshell is secured to the connector body.

Having thus described several embodiments of a connector that can be assembled and/or customized by a user, it should be apparent to those skilled in the art that certain advantages of the system and method have been achieved. It should also be appreciated that various modifications, adaptations, and alternative embodiments thereof may be made within the scope and spirit of the present invention. The invention is solely defined by the following claims.

What is claimed is:

1. A connector, comprising:

a connector body having a proximal end and a distal end, the distal end being configured to mate with a corresponding connector body;

a plurality of contacts, each one of said plurality of contacts having a proximal end and a distal end, the proximal end of each one of said plurality of contacts being configured for connection to at least one wire;

an elastomeric retainer having a plurality of apertures and at least one outer surface, said plurality of apertures being configured to receive said plurality of contacts; and a backshell configured to mate with said proximal end of said connector body;

wherein said proximal end of said connector body includes a cavity that is configured to accept said elastomeric retainer; and wherein said cavity is configured to apply pressure on said elastomeric retainer when said elastomeric retainer is inserted into said proximal end of said connector body, said pressure resulting in an increase in friction between each one of said plurality of apertures in said elastomeric retainer and each one of said plurality of contacts.

2. The connector of claim 1, wherein said connector body is a plug, and said corresponding connector body is a receptacle.

3. The connector of claim 1, wherein the proximal end of each one of said plurality of contacts includes a crimp barrel, allowing each one of said plurality of contacts to be crimped around a corresponding one of said at least one wire.

4. The connector of claim 1, wherein the proximal end of each one of said plurality of contacts includes a solder cup, allowing each one of said plurality of contacts to be soldered to a corresponding one of said at least one wire.

5. The connector of claim 1, wherein the elastomeric retainer includes a thermo-plastic elastomeric retainer.

6. The connector of claim 1, wherein each one of the plurality of apertures in the elastomeric retainer includes a plurality of inwardly protruding fingers, said plurality of inward protruding fingers are configured to apply a first level of friction to a corresponding contact before said elastomeric retainer is inserted into said cavity, and apply a second and greater level of friction to said corresponding contact after said elastomeric retainer is inserted into said cavity.

7. The connector of claim 1, wherein said backshell comprises first and second portions, said first portion including at least one latch and said second portion including at least one slot, said first and second portions being configured to be snap-fitted together by inserting said at least one latch into said at least one slot.

8. The connector of claim 7, wherein said first and second portions further include a first mating portion configured to mate with a second mating portion on said proximal end of said connector body, said first mating portion comprising at least one of at least one post and at least one hole.

9. The connector of claim 1, wherein said distal end of said connector body further includes a plurality of keyways, each one of said plurality of keyways being configured to receive a corresponding key, thereby allowing said distal end of said connector body to only mate with a corresponding connector body that is complimentary-keyed.

10. The connector of claim 1, further comprising said corresponding connector body, wherein:

said connector body further includes at least one latch having a proximal end and a distal end, the proximal end being pivotally connected to the connector body, and the distal end including at least one outwardly protruding dentent;

said corresponding connector body includes at least one pair of fingers having a deflectable outer portion and at least one indented inner portion; and said latch and said pair of fingers are configured to be snap-fitted together by pressing said at least one outwardly protruding dentent of said at least one latch through said deflectable outer portion of said at least one pair of fingers and into said at least one indented inner portion of said at least one pair of fingers.

11. The connector of claim 1, further comprising said corresponding connector body, wherein:

said corresponding connector body includes at least one latch having a proximal end and a distal end, the proximal end being pivotally connected to the corresponding connector body, and the distal end including at least one outwardly protruding dentent;

said connector body further includes at least one pair of fingers having a deflectable outer portion and at least one indented inner portion; and said latch and said pair of fingers are configured to be snap-fitted together by pressing said at least one outwardly protruding dentent of said at least one latch through said deflectable outer portion of said at least one pair of fingers and into said at least one indented inner portion of said at least one pair of fingers.

12. The connector of claim 1, further comprising said corresponding connector body and a lanyard mechanism, wherein:

said connector body includes at least a first dovetail;

said corresponding connector body includes at least a second dovetail;

said lanyard mechanism includes a first portion, a second portion substantially parallel to said first portion, and a third portion connecting said first and second portions, said first portion including a proximal end having at least one slot and a distal end having a latch; and said lanyard mechanism is interchangeably configurable in that said at least one slot in said proximal end of said first portion of said lanyard is configured to mate with both said first and second dovetails, and said latch in said distal end of said lanyard is configured to hook over a one of said first and second dovetails that is not being used to secure said proximal end of said first portion of said lanyard.

13. A connector, comprising:

a connector body having a proximal end and a distal end;

a plurality of contacts, each one of said plurality of contacts having a proximal end and a distal end;

an elastomeric retainer having a plurality of apertures, said plurality of apertures being configured to receive said plurality of contacts; and a backshell configured to mate with said proximal end of said connector body;

wherein said proximal end of said connector body is configured to accept said elastomeric retainer; and wherein said connector body is configured to apply pressure on said elastomeric retainer, and thereby on said plurality of contacts in said plurality of apertures, when said elastomeric retainer is inserted into said proximal end of said connector body, said pressure resulting in an increase of friction between said plurality of apertures and said plurality of contacts, thereby enhancing retention of said plurality of contacts in said plurality of apertures.

14. The connector of claim 13, wherein the elastomeric retainer includes a thermo-plastic elastomeric retainer.

15. The connector of claim 13, wherein each one of the plurality of apertures in the elastomeric retainer includes a plurality of inwardly protruding fingers, said pressure resulting in an increase of friction between said plurality of inward protruding fingers and said plurality of contacts.

16. The connector of claim 13, wherein said backshell comprises first and second portions configured to snap-fit together and onto said proximal end of said connector body.

17. The connector of claim 13, wherein said distal end of said connector body further includes a plurality of keyways configured to receive a plurality of user-removable keys.

18. The connector of claim 13, further comprising at least one latch having a proximal end and a distal end, the proximal end being pivotally connected to the connector body, and the distal end including at least one outwardly protruding dentent, wherein said distal end of said connector body is configured to mate with a corresponding connector body, and the outwardly protruding dentent is configured to mate with an indented portion on said corresponding connector body.

19. The connector of claim 13, further comprising a lanyard mechanism having a first portion, a second portion substantially parallel to said first portion, and a third portion connecting said first and second portions, wherein said first portion of said lanyard includes a slot configured to mate with a dovetail on said connector body and a latch configured to extend over a dovetail on a corresponding connector body.

20. A method of assembling a connector, comprising:

inserting a plurality of contacts into a plurality of apertures in a retainer;

increasing friction force between each one of said plurality of apertures in said retainer and corresponding ones of said plurality of contacts by inserting said retainer inside a distal end of a connector body; and connecting a backshell to said proximal end of said connector body;

wherein said insertion of said retainer into said distal end of said connector body results in an application of pressure on said retainer, which thereby results in an application of pressure on said plurality of contacts in said plurality of apertures.

21. The method of claim 20, further comprising the step of crimping at least one of said plurality of contacts to a wire prior to the step of inserting said plurality of contacts into said plurality of apertures in said retainer.

22. The method of claim 20, wherein the step of connecting said backshell to said proximal end of said connector body further comprises placing at least one post protruding outward from a distal end of said backshell in at least one corresponding hole in said proximal end of said connector body.

23. The method of claim 22, wherein said step of connecting said backshell to said proximal end of said connector body further comprises placing at least one latch protruding outward from a proximal end of a first portion of said backshell in at least one corresponding slot in a proximal end of a second portion of said backshell.

24. The method of claim 20, further comprising the step of selectively inserting at least one key into at least one keyway in a distal end of said connector body, thereby creating a user-keyed connector body that can be connected to a second complimentary-keyed connector body.

25. The method of claim 20, further comprising the step of connecting said connector body to a second connector body by rotating a latch on said connector body toward said second connector body, wherein said latch includes at least one dentent that is configured to mate with at least one indented portion on said second connector body.

26. The method of claim 20, further comprising the step of attaching a lanyard mechanism to said connector body by sliding at least one slot in said lanyard over at least one dovetail on said connector body.

27. The method of claim 26, further comprising the step of attaching said connector body to a second connector body by pressing said connector body and said second connector body together until at least one latch on said lanyard mechanism snaps over at least one dovetail on said second connector body.

28. The method of claim 26, further comprising the step of detaching said connector body from said second connector body by pulling on a handle portion of said lanyard to disconnect said at least one latch from said at least one dovetail on said second connector body.

* * * * *